US010184283B2

(12) United States Patent
Yeh

(10) Patent No.: US 10,184,283 B2
(45) Date of Patent: Jan. 22, 2019

(54) AUTOMATIC CRANKSHAFT HOMING DEVICE HAVING SPEED ADJUSTING FUNCTION

(71) Applicant: Neao International Co., Ltd., Songjiang District, Shanghai (CN)

(72) Inventor: Jen-Ping Yeh, New Taipei (CN)

(73) Assignee: Neao International Co., Ltd., Shanghai (CN)

( * ) Notice: Subject to any disclaimer, the term of this patent is extended or adjusted under 35 U.S.C. 154(b) by 0 days.

(21) Appl. No.: 15/548,452

(22) PCT Filed: Nov. 20, 2015

(86) PCT No.: PCT/CN2015/095234

§ 371 (c)(1),
(2) Date: Aug. 3, 2017

(87) PCT Pub. No.: WO2016/086775

PCT Pub. Date: Jun. 9, 2016

(65) Prior Publication Data

US 2018/0058124 A1 Mar. 1, 2018

(30) Foreign Application Priority Data

Dec. 1, 2014 (CN) ..... 2014 1 0717684

(51) Int. Cl.
*E05F 3/14* (2006.01)
*E05F 3/10* (2006.01)
(Continued)

(52) U.S. Cl.
CPC ..... *E05F 3/102* (2013.01); *E05F 3/02* (2013.01); *E05F 3/104* (2013.01); *E05F 3/225* (2013.01);
(Continued)

(58) Field of Classification Search
CPC . Y10T 16/577; Y10T 16/2804; Y10T 16/285; Y10T 16/293; Y10T 16/585;
(Continued)

(56) References Cited

U.S. PATENT DOCUMENTS 1,595,723 A * 8/1926 Norton ..... E05F 3/102 16/354
1,808,341 A * 6/1931 Burstein ..... E05F 3/02 16/70
(Continued)

FOREIGN PATENT DOCUMENTS

| | | |
|---|---|---|
| CN | 201933932 U | 8/2011 |
| CN | 102639804 A | 8/2012 |
| EP | 1329581 | 7/2003 |

*Primary Examiner* — Chuck Y Mah
(74) *Attorney, Agent, or Firm* — Bay State IP, LLC

(57) ABSTRACT

The present invention discloses a spindle with speed adjustment and automatic return device, included set up one resilient component, one cylinder, also one spindle and one cam of the same spindle on a base, between the cam and the resilient component set up one slider component, and one first rack set up on the slider component, both side of the cylinder set up with one cylinder rod and one flow adjustment valve, and one second rack set up on the cylinder rod, one gear set meshed in between the first rack and the second rack; the cam can follow spindle rotation and drive slider component move to the resilient component, to bring the first rack through gear set to drive the cylinder rod by the second rack, to make the cylinder through flow adjustment valve to suck the medium.

10 Claims, 9 Drawing Sheets

Figure 1A:
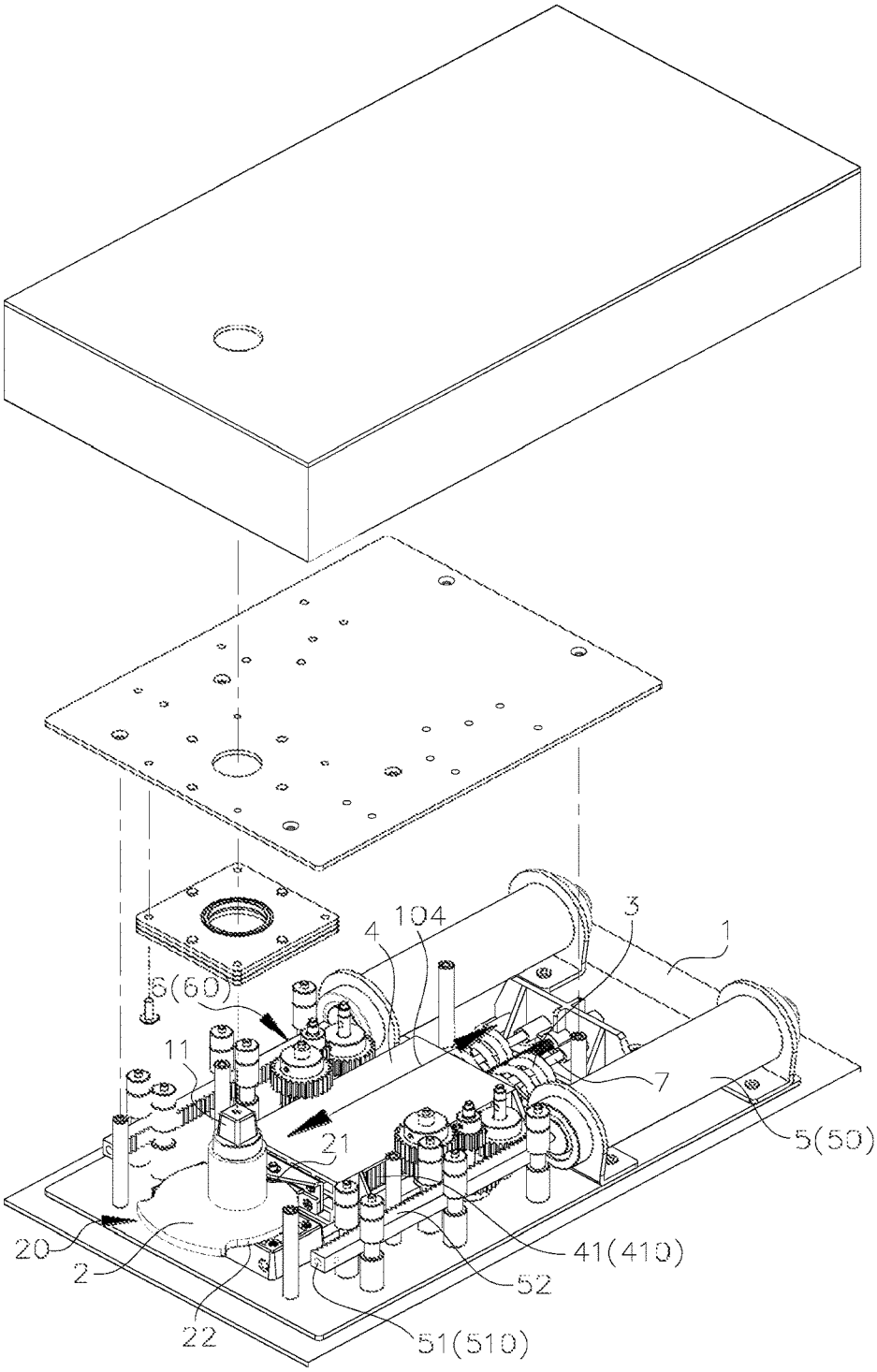

(51) Int. Cl.
*E05F 3/02* (2006.01)
*E05F 3/22* (2006.01)

(52) U.S. Cl.
CPC ... *E05Y 2201/618* (2013.01); *E05Y 2201/716* (2013.01); *E05Y 2201/722* (2013.01); *E05Y 2900/132* (2013.01)

(58) Field of Classification Search
CPC ..... Y10T 16/299; Y10T 16/286; Y10T 16/27; Y10T 16/2774; Y10T 16/2777; Y10T 16/56; Y10T 16/552; E05F 3/02; E05F 3/10; E05F 3/12; E05F 3/104; E05F 3/102; E05F 3/22; E05F 3/221; E05F 3/223; E05F 3/225; E05F 3/227; E05Y 2900/132; E05Y 2201/618; E05Y 2201/716; E05Y 2201/722
See application file for complete search history.

(56) References Cited

U.S. PATENT DOCUMENTS 2,585,625 A * 2/1952 Carlson ..... E05F 3/104 16/55
2,680,263 A * 6/1954 Hanssen ..... E05F 3/10 16/55
2,752,627 A * 7/1956 Carlson ..... E05F 3/104 16/275
2,933,755 A * 4/1960 Carlson ..... E05F 3/102 16/55
3,255,482 A * 6/1966 Flint ..... E05F 3/102 16/51
4,267,619 A * 5/1981 Suska ..... A62C 2/248 16/48.5
4,658,468 A 4/1987 Baubeschlag
4,660,250 A * 4/1987 Tillman ..... E05F 1/006 16/58
5,048,151 A * 9/1991 Orii ..... E05F 3/00 16/49
5,187,835 A * 2/1993 Lee ..... E05F 3/102 16/52
5,193,647 A * 3/1993 O'Brien, II ..... E05F 1/105 16/49
5,243,735 A * 9/1993 O'Brien, II ..... E05F 3/104 16/49
5,259,090 A * 11/1993 Fayngersh ..... E05F 3/102 16/51
5,553,353 A * 9/1996 Lin ..... E05F 3/06 16/59
6,151,753 A * 11/2000 Salutzki ..... E05F 3/10 16/49
8,966,712 B1 * 3/2015 Yu ..... E05F 3/02 16/66
2002/0133904 A1 * 9/2002 Donovan ..... E05F 3/16 16/49
2003/0213092 A1 * 11/2003 Fischbach ..... E05F 3/102 16/52
2004/0205930 A1 * 10/2004 Huang ..... E05F 3/00 16/64
2005/0246860 A1 * 11/2005 Huang ..... E05F 3/102 16/79
2007/0067950 A1 * 3/2007 Johnson ..... E05F 3/104 16/63
2009/0320236 A1 * 12/2009 Yamamuro ..... E05F 3/102 16/64
2013/0086771 A1 * 4/2013 Blockley ..... E05F 3/12 16/56
2015/0315833 A1 * 11/2015 Lee ..... E05F 3/102 16/52
2015/0322705 A1 * 11/2015 Lee ..... E05F 3/102 16/53

* cited by examiner

AUTOMATIC CRANKSHAFT HOMING DEVICE HAVING SPEED ADJUSTING FUNCTION

CROSS REFERENCE TO RELATED APPLICATION

This application is for entry into the U.S. National Phase under § 371 for International Application No. PCT/CN2015/095234 having an international filing date of Nov. 20, 2015, and from which priority is claimed under all applicable sections of Title 35 of the United States Code including, but not limited to, Sections 120, 363, and 365 (*c*), and which in turn claims priority under 35 USC 119 to Chinese Patent Application No. 201410717684.7 filed on Dec. 1, 2014.

TECHNICAL FIELD

This invention relates to a kind of spindle with speed adjustment and automatic return device for door closer or floor spring can automatically slow closing the door panel after the door panel opened. More particularly, this invention provides a automatic return device let the spindle of door closer, concealed transom closer or floor spring automatic slow return with precise speed adjustment.

TECHNICAL BACKGROUND

At present, the door closer which installed on the top of the door or the floor spring which installed on the bottom of the door provided with a spindle on basement which can be connected to the door panel. Moreover, the spindle can control the rotational speed by the hydraulic mechanism, which accumulate preparatory pressure when the spindle rotated from the door opening. When the door is released, the door panel is slowly rotated to return to the closed position, because the hydraulic mechanism can provide a resistance to the return rotation of the spindle.

The hydraulic mechanism is generally provided with an adjustment valve, which can adjust the opening rate of the oil return passage for the oil in the hydraulic mechanism. It is thereby adjusting the flow rate of the oil to adjust the volume of the preparatory pressure which from oil accumulation and then control the speed of automatic return of the door panel.

However, the maximum angle of the opened door is between 90 to 180 degrees approximately, which means the distance from the spindle rotation by door panel is not long. The hydraulic mechanism must have the enough preparatory pressure from oil accumulation to resist the return rotation of the spindle by short distance from the spindle rotation. Even if the adjustment valve of the hydraulic mechanism is slightly adjusted, the preparatory pressure accumulated in the hydraulic mechanism is greatly changed, resulting in difficult to precision adjust the preparatory pressure, and so let the speed of the door closing too slow or too fast.

In addition, the pressure required to rotate the rest of the machine shaft is reduced by a much lower speed ratio after a gear shift. Therefore, the resistance pressure required for the medium is relatively low in the case of the same load. In the current market, because the floor spring or door closer operate with high pressure, if it's without strict quality control, it's easy to have leakage situation. Moreover, after a certain period of time, the high pressure is also easy to damage the oil seal and oil leakage, affecting the product life.

THE CONTENT OF INVENTION

The purpose of the present invention is to provide a spindle with speed adjustment and automatic return device, having a structure capable of increasing the move distance to provide between a spindle and an accumulating structure for automatically resetting the preliminary pressure to overcome the prior technical problem. So even a slight adjust to the hydraulic adjustment valve causes the hydraulic mechanism to accumulate the preparatory pressure to generate a greatly change, so it is difficult to precision adjust the preparatory pressure, which let door panel close too slow or too fast and because the oil leakage impacted negatively on product's service life.

In order to solve the above-mentioned problems, the present invention has a spindle with speed adjustment and automatic return device, and it comprises components in a base as follow.

A spindle, a push component mounted on said spindle and have a push path.

A sliding component which receives a pushing path from said push component and having a tendency to push said slider toward along a move path from the first position to the second position. A resilient component which provides a slider with a function of returning from the second position to the first position.

At least a first traction portion is provided on said slider. Fifthly, at least one energy storage component has a push portion for storing energy by the energy storage component by the movement of the push portion, and the stored energy may also generate a push effect by the push portion.

At least one push route conversion component coupled between the first traction portion and the push portion, and generate a longer move distance to the push portion then the first traction portion. Wherein the push component comprises a cam, using the edge of the cam to have the push trajectory of the slider. The slider being interposed between the cam and the resilient component, the first traction portion comprises a first rack and it extends along the movement path; Said, energy storage component contained a cylinder, the push portion includes a cylinder rod (protruding from the cylinder) acting on the push route conversion component, and a second rack having a function on the cylinder rod, and the other end of the cylinder with at least one flow regulating valve, said, the push conversion comprises a gear set, which meshing between the first rack and the second rack; the mentioned, the energy storage component equipped with an energy medium input and output component, The input and output component are further provided with a flow regulating valve, the cam can followed the spindle rotation and moved along the pushing path to move the slider to the resilient component direction, bring the first rack through the gear set to drive the cylinder rod by the second rack, and the resilient component is capable of elastically driving the slider toward the cam direction, bring the first rack through the gear set to reverse drive the cylinder rod by the second rack, wherein the cylinder sucks and discharges the medium via the piston and the flow regulating valve when the cylinder rod is driven, and the flow control valve can control the flow rate of the cylinder suction and discharge medium, thereby adjusting the push out speed when the push portion generated.

By means of the above, the spindle can be provided as the spindle or turning spindle of door closer, floor spring or conceal transom closer, said the door closer, floor spring or conceal transom closer can be install on the door panel. Said the resilient component in normal condition can elastically driving the slider to push the cam, when opening the door, cam and spindle can followed the door panel rotation to make the cam to drive the slider moving toward the resilient component direction, and compressing the resilient component, and the first rack moves in the direction of the resilient component with the slider, to make the first rack through the gear set to drive the second rack, and then drive the cylinder's rod and piston, to drive the cylinder through the flow regulating valve to suck the medium, to form a preliminary pressure to resist the automatically return of the spindle.

When the door panel turned loose, the resilient component immediately releases the compression force and elastically drives the slider moving toward the cam direction, and the first rack followed the slider as well, to make the first rack through the gear set to drive the second rack, and then reverse drives the rod and the piston of the cylinder, to drive the cylinder body through the flow regulating valve to discharge media; during which, because of the flow regulating valve limited the flow volume of the medium output from the cylinder, so, the second rack is moved slowly with the cylinder rod and the piston, that make the second rack through the gear set and slowly drive the first rack, make the slider to follow the first rack slowly push the cam and spindle to rotate return, to force the door to return to the closed position as the spindle slowly rotates.

In this way, the short-distance from rotation stroke of the spindle can be converted into a long-distance linear movement through the first rack and the gear set, the long-distance linear movement of the second rack, the cylinder rod and the piston compare to the short-distance from rotation of the spindle, is obviously easy to adjust by the flow regulating valve for precise movement; therefore, when attempt to adjust the speed of the door panel automatically return and closed, can through the flow regulating valve directly adjust flow of the medium when the cylinder suction and discharge, then slightly adjust the second rack, cylinder rod and piston movement per second, and then precisely adjust the spindle automatically return speed.

According to the above-described structure, the slider slide on at least one sliding track component. The slider is further set a guide component for string the resilient component. According to the above construction, the cam droved the cylinder rod out of the cylinder through the first rack, the gear set and the second rack, the resilient component through the first rack of the slider, the gear set and the second rack to drive the cylinder rod into the cylinder. Or, the cam through the first rack of the slider, gear set and the second rack to drive the cylinder rod into the cylinder, resilient component through the first rack of the slider, gear set and the second rack to drive the cylinder rod out of the cylinder. According to the above-mentioned structure, the push component is provided with a concave for the slider to fix position, and a convex for driving the slider to shift out.

According to the above-described structure, the part of the slider is provided with a roller capable of pressing against the push component, to reduce the frictional force between the slider and the cam, so that the cam and the slider can be smoothly transmitted with each other.

According to the above-described structure, the flow regulating valve includes a one-way discharge flow regulating valve and a suction flow regulating valve or a control valve, the discharge flow regulating valve capable of adjusting the discharge flow of the medium in the cylinder, to control the automatic closing speed of the door panel; and the one-way suction flow regulating valve or the control valve is capable of controlling the suction flow of the medium sucked into the cylinder, to control the door panel speed when accept opening.

According to the above-described structure, the second rack extends along with the displacement path, can save the second rack occupied installation space.

According to the above-described structure, the gear set can be set as the forming relative acceleration gear set from the first traction portion toward the pushing portion, to promote the linear movement distance of second rack, cylinder rod and piston.

According to the above-described structure, the base is provided with a stop bolts which limited the position of slider which produce movement from the first position toward the second position on the movement path, to limit the movement volume of the slider moving toward the resilient component direction.

THE EXPLANATION OF FIGURE

Figure 1B:
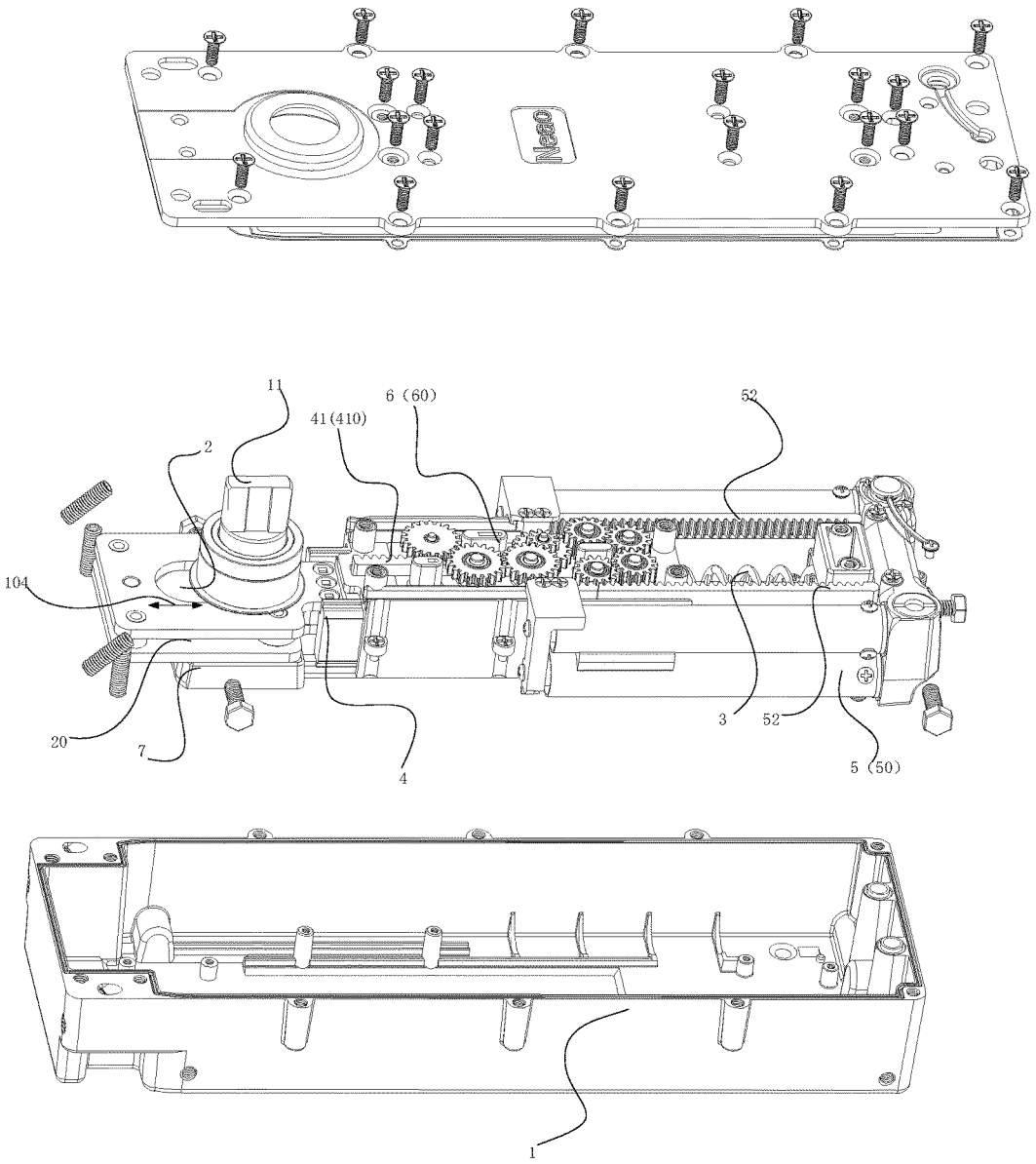
Figure 2A:
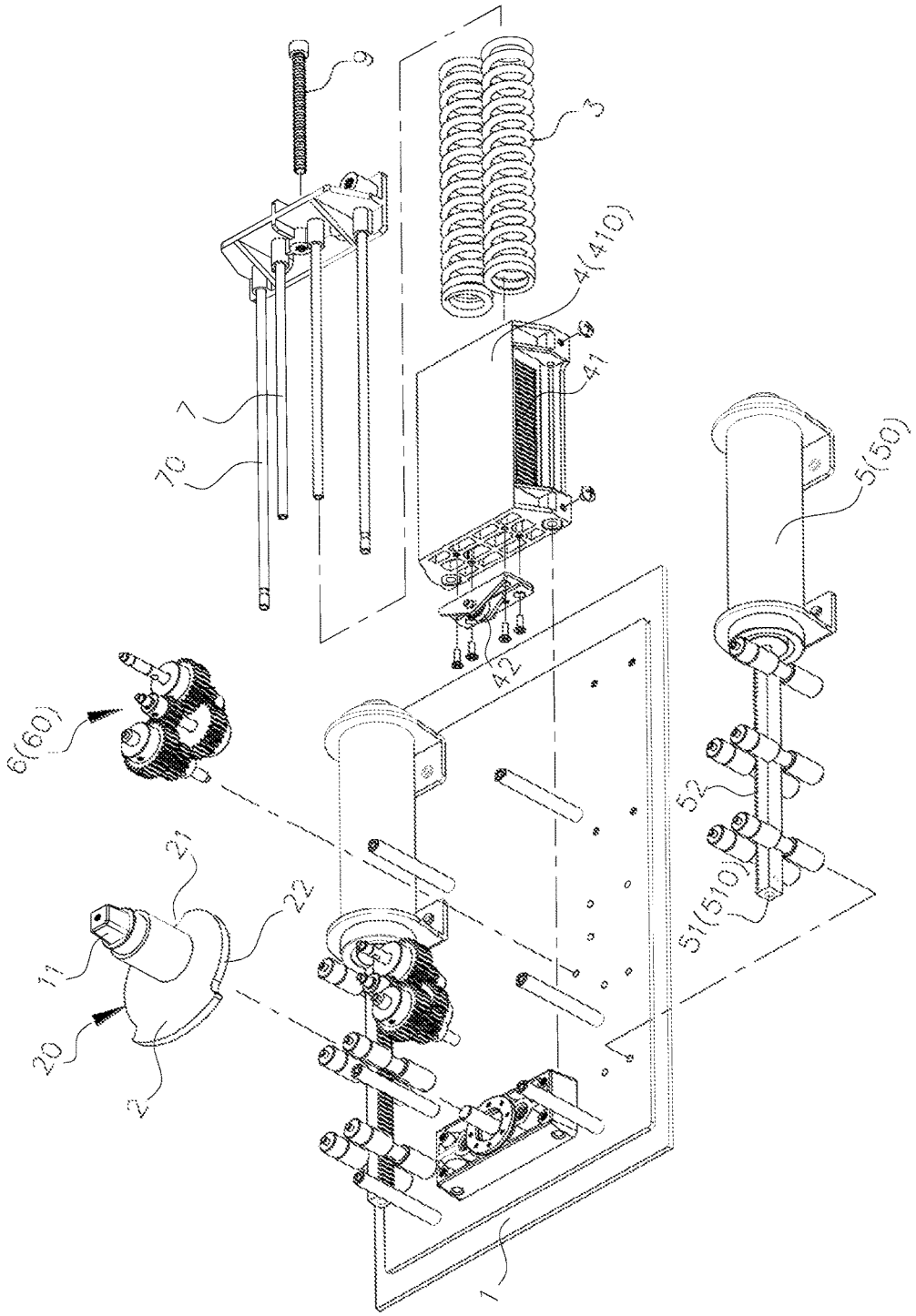

FIG. 1*a* is an exploded view of a preferred embodiment of the present invention;

FIG. 1*b* is an exploded view of a preferred embodiment 2 of the present invention;

FIG. 2*a* is a detailed exploded view of FIG. 1*a;*

Figure 2B:
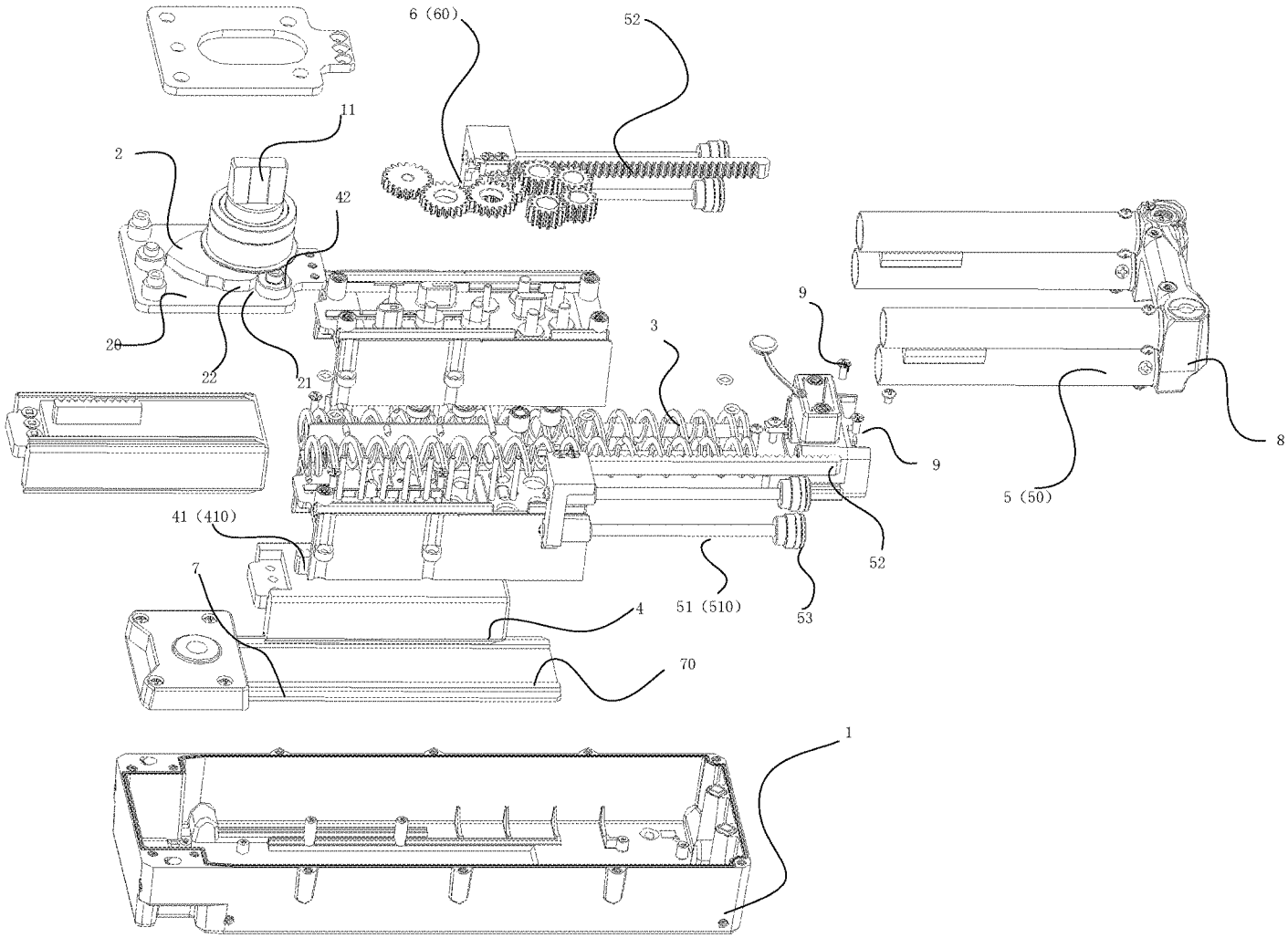

FIG. 2*b* is a detailed exploded view of FIG. 1*b;*

Figure 3A:
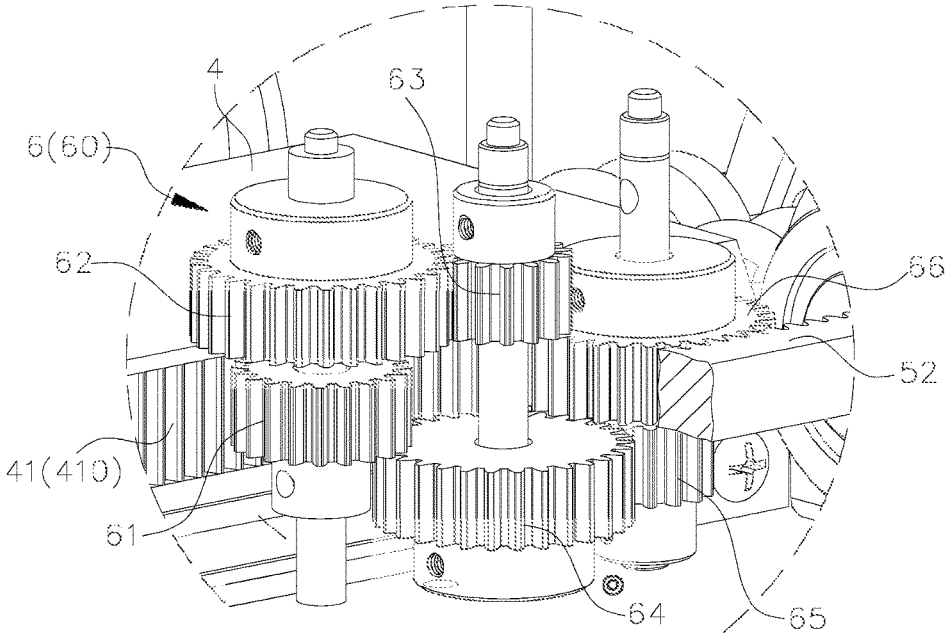

FIG. 3*a* is a partially enlarged view of FIG. 1*a;*

Figure 3B:
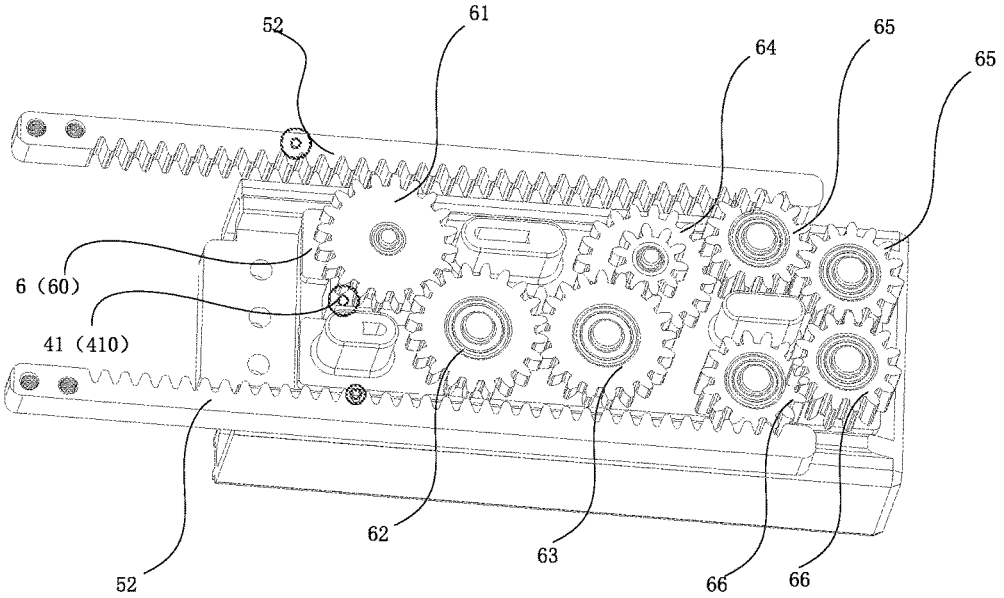

FIG. 3*b* is a partially enlarged view of FIG. 1*b;*

Figure 4A:
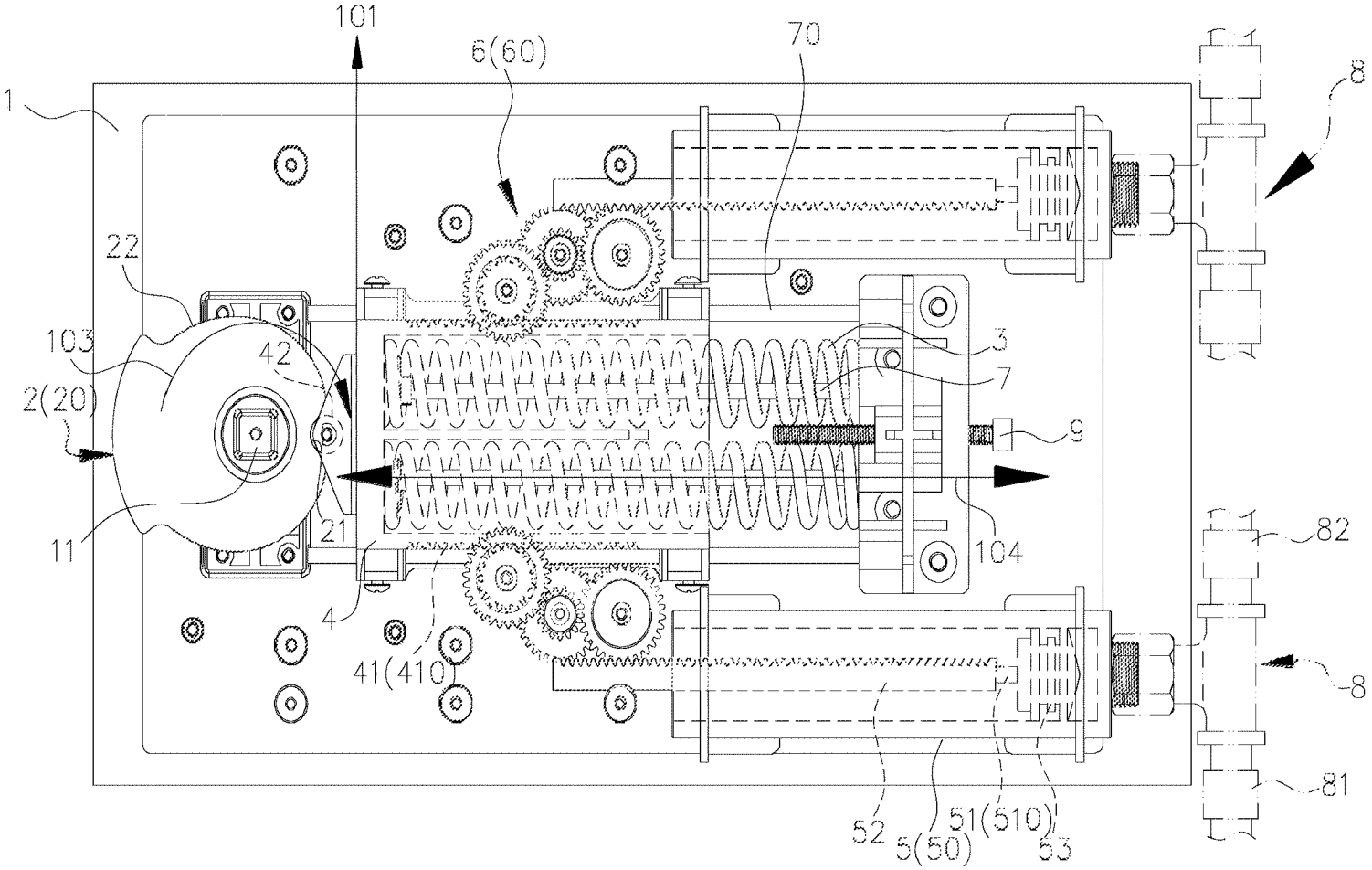

FIG. 4*a* is a top view of one use state of the embodiments of FIG. 1*a;*

Figure 4B:
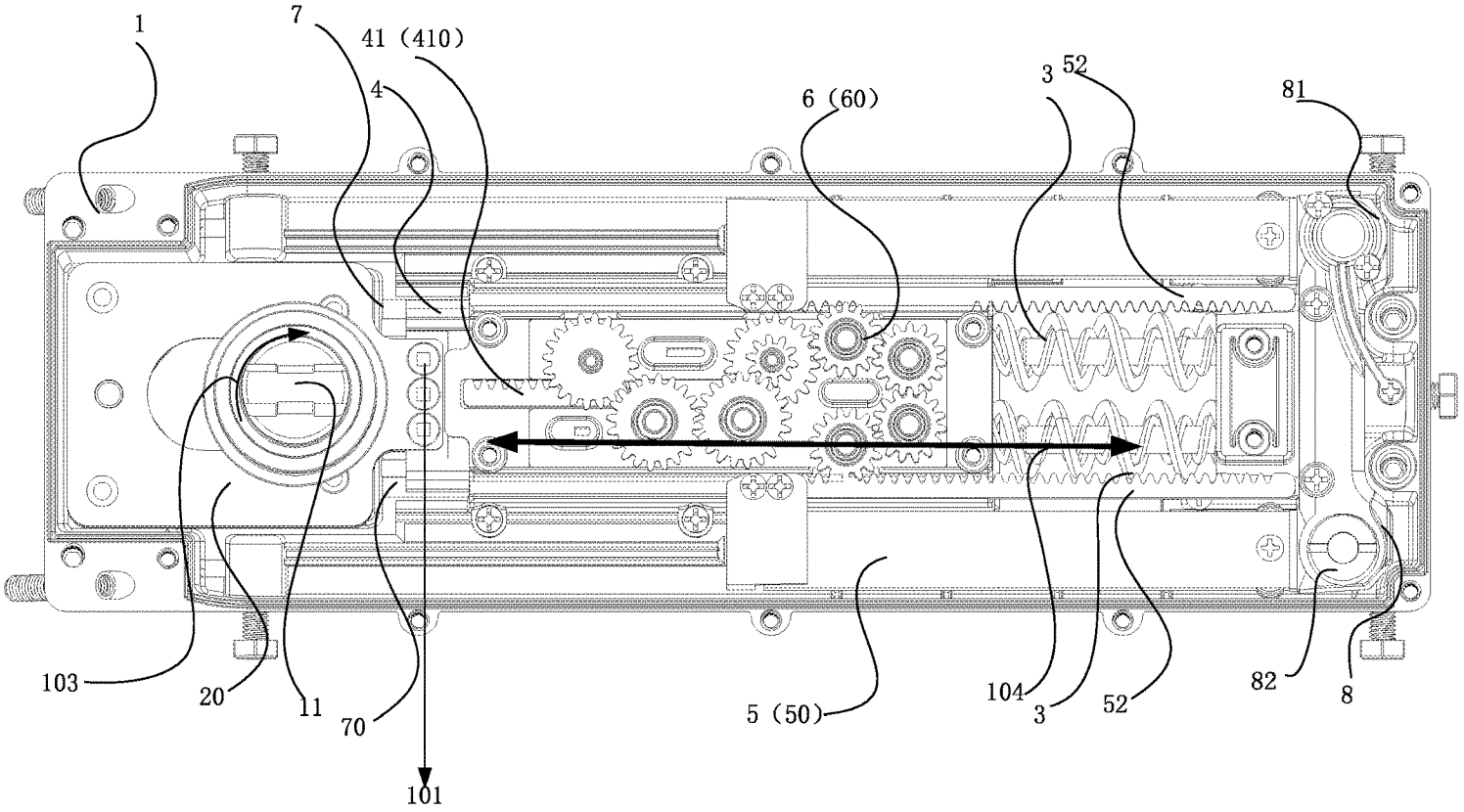

FIG. 4*b* is a top view of one use state of the embodiments of FIG. 1*b;*

Figure 5A:
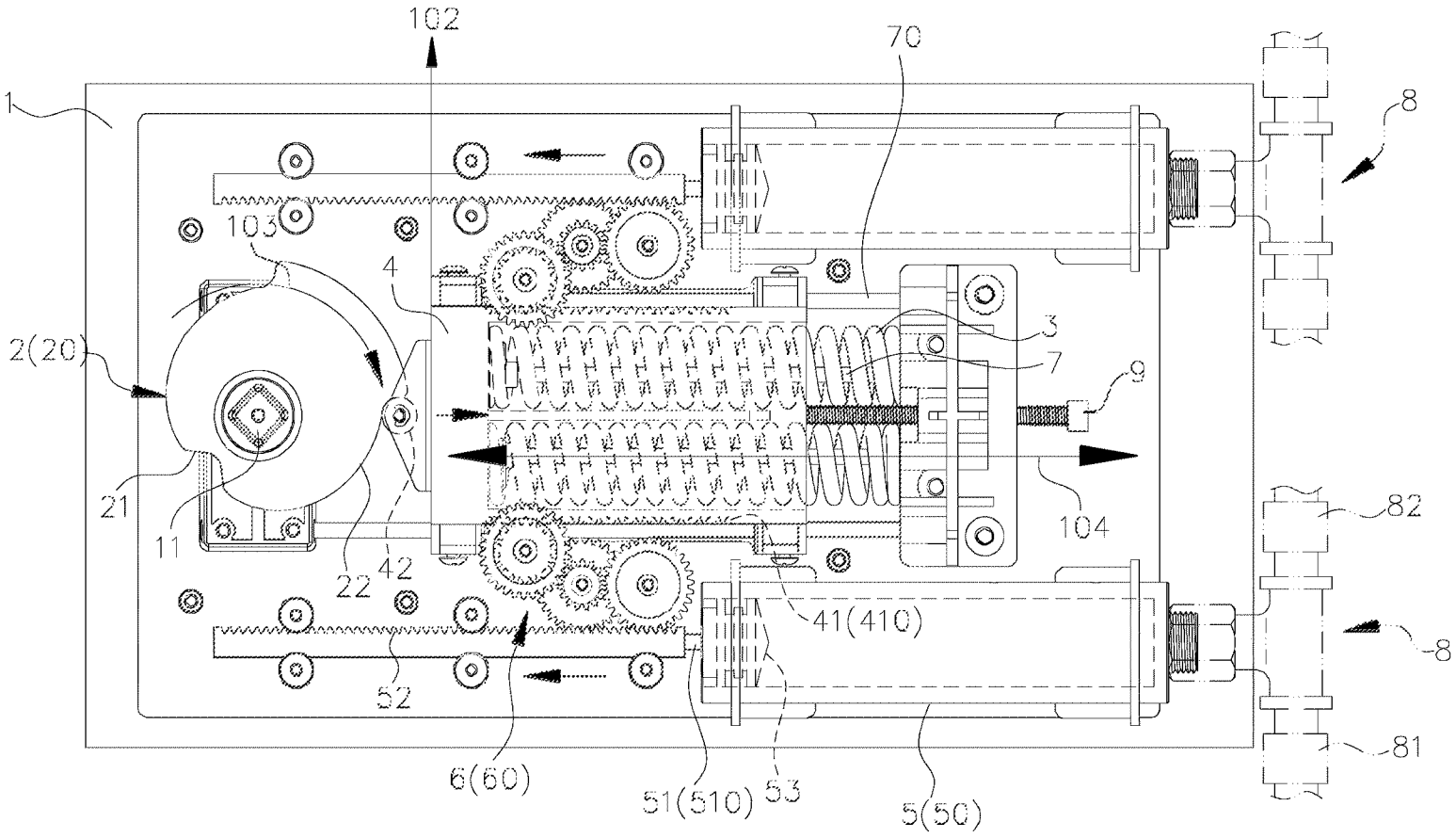

FIG. 5*a* is a top view of another use state of the embodiment of FIG. 1*a;*

Figure 5B:
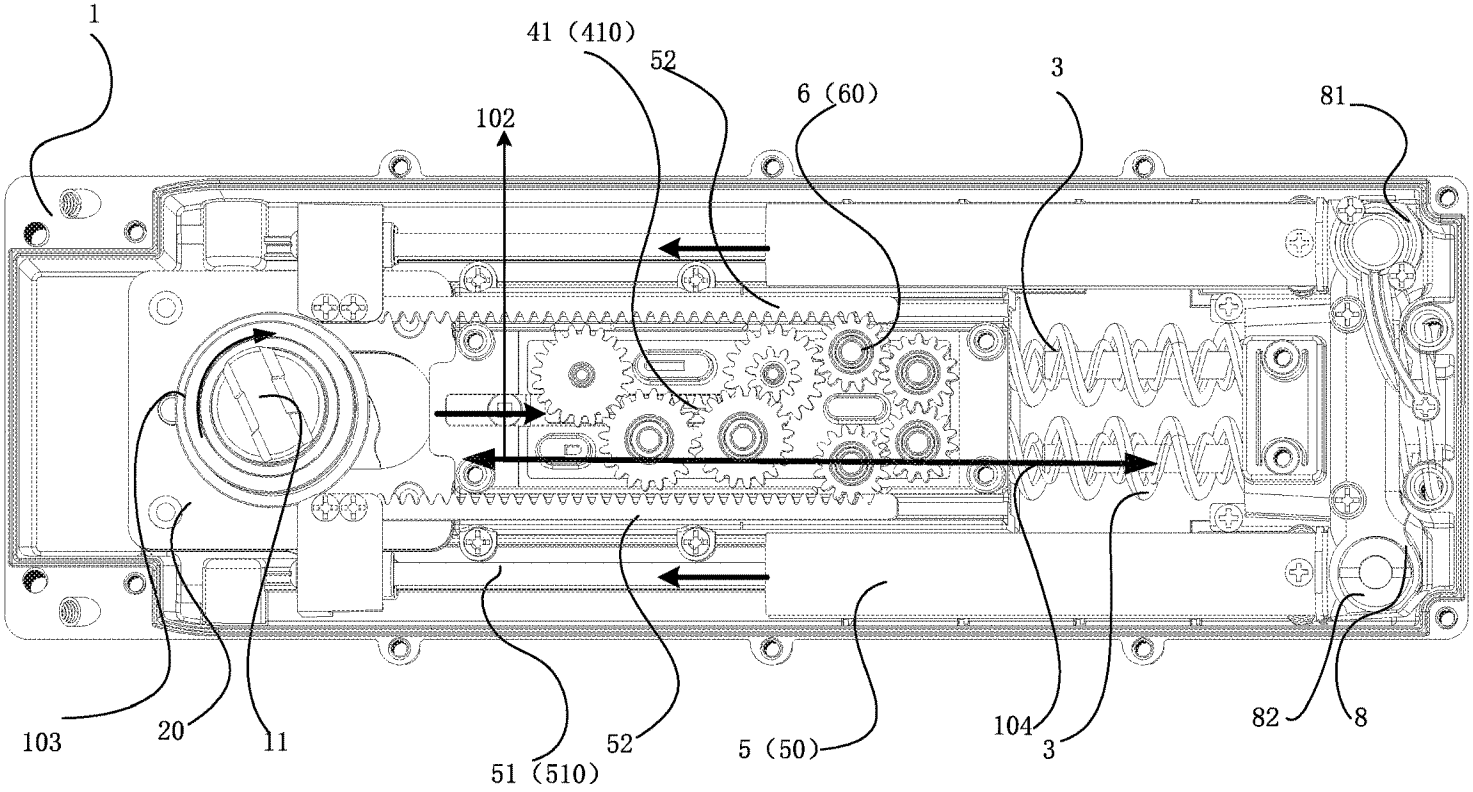

FIG. 5*b* is a top view of another use state of the embodiment of FIG. 1*b.*

Wherein the reference numerals in figure are explain as below:

1 is the base
101 is the first position
102 is the second position
103 is the moving trajectory
104 for the movement path
11 for the spindle
2 for the cam as a push component
21 is a concave part
22 is a convex part
3 is the resilient component
4 is the slider
41 is the first rack
410 is the first traction portion
42 for the roller
5 for the cylinder
50 for the energy storage component
51 is the cylinder rod
510 for the pushing portion
52 is a second rack
53 for the piston
6 for the gear set
60 is a push route conversion component
61, 62, 63, 64, 65, 66 as the gears
7 for the guide
70 as a sliding track component
8 for the flow adjustment valve
81 is a one-way discharge flow adjustment valve
82 is a one-way suction flow adjustment valve or control valve
9 as a stop bolt.

THE CONCRETE IMPLEMENT WAY

The detailed description of the preferred embodiments and the present invention will now be described in further detail with reference to the accompanying drawings and specific embodiments. In the present invention, FIGS. 1*a*, 2*a*, 3*a*, 4*a*, and 5*a* are the better example 1 of spindle with speed adjustment and automatic return device, FIGS. 1*b*, 2*b*, 3*b*, 4*b* and 5*b* are the better example 2.

Please refer to FIGS. 1*a*, 1*b* and 3*a*, 3*b* for the implementation method of the present invention icon, the mentioned icon explaining the present invention has the spindle with speed adjustment and automatic return device, including in the base 1 is provided with a spindle 11, a push component 20, a slider 4, a resilient component 3, at least one first traction portion 410, at least one energy storage component 50, and at least a push route conversion component 60; the push component 20 is set on the spindle 11, the push component 20 has a push track 103 (as shown in FIGS. 5*a*, 5*b*); the slider 4 accepted the function of push track 103 from the push component 20, and have the tendency of push slider 4 along with movement path 104, from a first position 101 (as shown in FIGS. 4*a*, 4*b*) slide toward a second position 102; resilient component 3 to the slider 4 provided with the function from second position 102 returned to first position 101; the first traction portion 410 is set on the slider 4; the energy storage component 50 has a push portion 510, through the movement of pushing portion 510, can make the energy storage component 50 stored energy and the stored energy can also push out by the push portion 510, push route conversion component 60 is connected between the first traction portion 410 and the push portion 510, let the push portion 510 has enlarged movement than the first traction portion 410.

In a more specific implementation, the push component 20 comprises a cam 2 which set on the spindle 11 for drive the cam 2 coaxial rotation with the spindle 11, use the edge shape of the cam 2 to from the movement path 103 of pushing the slider 4, and make the slider 4 able to slide along with the movement path 104 in between the cam 2 and the resilient component 3. The slider 4 is sliding on at least one slide track component 70, and the slide track component 70 can be a slide pin or slide base, and the slider 4 is set with at least one guide component 7 which through resilient component 3 and setting between the cam 2 and the resilient component 3, and the guide component 7 extends along with the movement path 104, the guide component 7 can set as a guide rod, guide base or (and) guide pipe, and the slider 4 is slide on the guide 7. The first traction portion 410 includes a first rack 41 set on the slider 4 and the first rack 41 extends along with the movement path 104 on the surface of the slider 4.

The energy storage component 50 comprises a cylinder 5, which can be a pneumatic cylinder or a hydraulic cylinder, the cylinder 5 has a piston 53 set inside, the push portion 510 includes one cylinder rod 51 extending from cylinder 5 which function is to the push route conversion component 60, and a second rack 52 acting on the cylinder rod 51; in particular, the cylinder rod 51 is connected to the piston 53 and the second rack 52 set on the cylinder rod 51, so that the second rack 52 extends along with the movement path 104.

The cylinder 5 is provided with cylinder rod 51 at one end, an energy medium inlet and outlet component provided with a flow adjustment valve 8 are set on the energy storage component 50, in fact, the flow adjustment valve 8 can be set on the other side of cylinder 5. The flow adjustment valve 8 can control the medium flow of the suction and discharge of the cylinder 5, thereby adjusting the push out speed that the push portion 510 produced. When the cylinder 5 is a pneumatic cylinder, the medium can be the gas; when the cylinder 5 is a hydraulic cylinder, the medium can be the oil.

The route conversion component 60 comprises a gear set 6, which included many intermeshing gears 61, 62, 63, 64, 65, 66, and the gears 61, 62, 63, 64, 65, 66 engaged between the first rack 41 and the second rack 52, and the gear set 6 can be set as relative speed up gear set from the first traction portion 410 toward the push portion 510. In the present embodiment, the first rack 41, the cylinder 5 and the gear set 6 can be set several sets, and the first rack 41 can be set on both sides of the slider 4, and the cylinder 5 and the gear set 6 can be set on both sides of the base 1, so that the slider 4 and the resilient component 3 are located between cylinder 5.

As shown in FIGS. 5*a* and 5*b*, the cam 2 is able to rotate with spindle 11, and drive the slider 4 along the movement track 103 toward the direction of the resilient component 3, to bring the first rack 41 through the gear set 6 to drive cylinder rod 51 by the second rack 52. As shown in FIGS. 4*a* and 4*b*, the resilient component 3 is capable of resiliently drive the slider 4 moving to the direction of the cam 2, to bring the first rack 41 through the gear set 6 and the second rack 52 reverse drive cylinder rod 51.

In detail, the cam 2 through first rack 41 of the slider, the gear set 6 and second rack 52 to drive the cylinder rod 51 to move out from the cylinder 5, resilient component 3 through the first rack 41 of slider 4, the gear set 6 and the second rack 52 to drive the cylinder rod 51 retract to the cylinder 5. Or, cam 2 through the first rack of slider 4, the gear set 6 and the second rack 52 drive the cylinder rod 51 retract to the cylinder 5, the resilient component 3 through the first rack of slider 4, the gear set 6 and the second rack 52 to drive cylinder rod 51 move out from the cylinder 5.

During the cylinder rod 51 accepted the driving, the cylinder 5 sucks and discharges the medium via the piston 53 and the flow adjustment valve 8, and the flow adjustment valve 8 includes a one-way discharge flow adjustment valve 81 and a suction flow adjustment valve 82, the flow adjustment valve 8 can also be one capable of controlling the medium discharge and (or) suction flow control valve. The one-way discharge flow adjustment valve 81 smoothly discharges the medium out of the cylinder 5, and can adjusted the discharge flow of the medium in the cylinder 5. The one-way suction flow adjustment valve 82 smoothly sucks the medium into the cylinder 5 and is capable of adjusting the suction flow when the medium into the cylinder 5

And the one-way suction flow adjustment valve 82 is closed when the cylinder 5 discharges the medium.

The end side of slider 4 has provided with roller 42 which touchable the cam 2 of push component 20, to reduce the frictional force between the slider 4 and the cam 2 so that the cam 2 and the slider component 4 can be smoothly transmitted with each other. The cam 2 of the push component 20 have a concave part 21 for the roller 42 of the slider 4 to position by pushing, and a convex part 22 can drive the slider 4 toward the direction of the resilient component 3. The base 1 is provided with a stopper bolt 9 to limit the end position of slider 4 which move from second position 102 toward the first position 101 on the movement path 104, can limit and adjust the movement volume of slider 4 toward to the resilient component 3

Through the above-described components assembly, can set the spindle 11 as a spindle or rotation spindle of door closer, floor spring or a concealed transom closer, the mentioned door closer, floor spring or a concealed transom closer can install on the top or bottom of the door panel. FIGS. 4*a* and 4*b* depict that the resilient component 3 can resiliently drove the slider 4 to the first position 101 in normal condition and made the roller 42 of the slider 4 to push against the concave part 21 of the cam 2. As shown in FIGS. 5*a* and 5*b*, when the door panel is opened, the cam 2 and the spindle 11 are able to rotate with the door panel, and made convex part 22 of the cam 2 along with the push path 103 to drive the slider 4 to the direction of the resilient component 3, and let the slider 4 moving to the second position 102, and force the slider 4 to press the resilient component 3 to store the elastic force, in the meantime, first rack 41 followed the slider 4 and moved to the direction of the resilient component 3, so that the first rack 41 via the gear set 6 to drives the second rack 52, and then drive the cylinder rod 51 and the piston 53 of the cylinder 5, to let the cylinder rod 51 move out of the cylinder 5, and drive the cylinder 5 to suck the medium through the one-way suction flow adjustment valve 82 to form a preliminary pressure for against the automatic return of the spindle 11.

Referring to FIGS. 4*a* and 4*b* again, when the door is released, the resilient component 3 immediately releases the compressive force and resiliently drive slider 4 moving to the direction of the cam 2, and let the slider 4 move to the first position 101, and the first rack 41 followed slider 4 moving to the direction of cam 2, and let the first rack through the gear set 6 to drive the second rack 52, and then reverse drive the cylinder rod 51 and the piston 53 of the cylinder 5, to let the cylinder rod 51 retracted into the cylinder 5, and drive the cylinder 5 through the one-way discharge flow adjustment valve 81 to discharge the medium, in the meantime, because the one-way discharge flow adjustment valve 81 limit the flow of discharged medium from the cylinder 5 to the outside, so, the second rack 52 will move slowly by follow cylinder rod 51 and piston 53, and let the second rack 52 through gear set 6 slowly drive the first rack 41, to let slider 4 followed the first rack slowly push against cam 2 and spindle 11 to rotate and return, force the door panel followed spindle 11 slowly turning and return to the close position.

According to the above, the short-distance from rotation distance of spindle 11, can pass the first rack 41 and gear set 6 to turned to the long-distance linear movement distance of the second rack 52, compare to the adjustment of short-distance from rotation distance of spindle 11, the long-distance linear movement distance of the second rack 52, cylinder rod 51 and piston 53, obviously easy to through the one-way discharge flow adjustment valve 81 to make the precise movement adjustment; therefore, when want to adjust the speed of door panel automatic return close, can through the one-way discharge flow adjustment valve 81 directly control the discharged medium flow of cylinder 5, can slightly adjusted the movement per second of the second rack 52, cylinder rod 51 and piston 53, and then precise adjusted the automatic return speed of spindle 11.

According to this, through in between the spindle 11 and the push portion 510 of energy storage component 50, set up the first traction portion 410, push route conversion component 60 and the second rack 52 that can increase the rotation distance of the spindle 11, to reach the purpose of above mentioned precise adjusted automatic return speed of spindle 11, and overcome the above mentioned prior technology, slightly adjusted hydraulic mechanism adjustment valve, but produce the significant change of preparatory pressure which accumulate by hydraulic mechanism, result in defects of the difficulty of precise adjusting preparatory pressure, and make the door panel easy to produce the closing speed too slow or too fast, and influence on its service life caused by oil leakage.

The above description is just the better embodiment of this invention, and any changes, modifications, alterations or equivalent permutations which extending in accordance with the technical means and scope of this invention are intended to fall within the protection range of the present applied patent.

INDUSTRIAL APPLICABILITY

The Spindle with speed adjustment and automatic return device provided by the present invention, through the spindle short-distance from rotation distance can pass the first rack and gear set converted into a long-distance linear movement distance of the second rack, compared with the adjustment of the short-distance from rotation distance of the spindle, the mentioned long-distance linear movement distance of the second rack, cylinder rod and piston, obviously easy to through the flow adjustment valve to make precise adjustment of the movement; therefore, when wanted to adjusted the door panel automatic return close speed, can through the mentioned flow adjustment valve and directly adjusted the cylinder flow of suction and discharge medium, and then can slightly adjusted the movement per second of the second rack, cylinder and piston, then precise adjusted the spindle automatic return speed, with industrial applicability.

What is claimed is:

1. A spindle with speed adjustment and automatic return device contained within a base comprising:

one spindle rotatably mounted on the base;

one push component comprising a cam, set on the spindle, with a push path;

one slider, wherein the slider is configured to engage the cam of the push component and having the tendency of sliding along a movement path from a first position toward a second position;

one resilient component acting on said slider, providing the function of returning from the second position to the first position of the slider;

at least one traction portion, set up on the slider;

at least one energy storage component, having one push portion, to allow the energy storage component to store energy through movement of the push portion, wherein the stored energy is able to produce a push out function of the push portion; and at least one push route conversion component, connected between the at least one traction portion and the push portion, such that a short-distance linear movement of the at least one traction portion can be converted into a long-distance linear movement of the push portion.

2. According to claim 1, the spindle with speed adjustment and automatic return device, wherein the energy storage component further comprises:

an energy medium input/output component, wherein the energy medium input/output component further comprises a flow adjustment valve, configured to control the flow of suction and discharge of the energy storage component, and also adjusts the push out speed produced by the push portion.

3. According to claim 2, the spindle with speed adjustment and automatic return device, wherein the flow adjustment valve comprises a one one-way discharged flow adjustment valve, and at least one one-way suction flow control valve.

4. According to claim 1, the spindle with speed adjustment and automatic return device, wherein the first traction portion comprises one first rack, and the first rack extended along with the said movement path.

5. According to claim 4, the spindle with speed adjustment and automatic return device, wherein the energy storage component comprises one cylinder, the push portion included one cylinder rod out from the cylinder and function on the push route conversion component, and a second rack which setup on the cylinder rod.

6. According to claim 5, the spindle with speed adjustment and automatic return device, wherein the route conversion component comprises one gear set, said gear set meshing between the first rack and the second rack.

7. According to claim 5, the spindle with speed adjustment and automatic return device, wherein the second rack is extended along with the movement path.

8. According to claim 1 the spindle with speed adjustment and automatic return device, wherein the push route conversion component is set up as a relative acceleration gear set from the at least one traction portion toward the push portion, to promote the linear movement distance of the push portion.

9. According to claim 1, the spindle with speed adjustment and automatic return device, wherein the slider is located between the cam and the resilient component.

10. According to claim 1, the spindle with speed adjustment and automatic return device, wherein the slider is set up on at least one sliding track component.

* * * * *